US005809680A

United States Patent [19]

Scheidler et al.

[11] Patent Number: 5,809,680

[45] Date of Patent: Sep. 22, 1998

[54] ARRANGEMENT FOR DISPLAYING INFORMATION AND OPERATING STATES ON A COOKING APPARATUS

[75] Inventors: Herwig Scheidler, Mainz; Bernd Schultheis, Schwabenheim; Martin Taplan, Rheinböllen; Erich Schröder, Werdohl, all of Germany

[73] Assignee: Schott Glaswerke, Mainz, Germany

[21] Appl. No.: 502,172

[22] Filed: Jul. 13, 1995

[30] Foreign Application Priority Data

Jul. 14, 1994 [DE] Germany ..... 44 24 847.4

[51] Int. Cl.[6] ..... G09F 13/06

[52] U.S. Cl. ..... 40/580; 40/594; 219/453; 219/506

[58] Field of Search ..... 40/564, 575, 580, 40/594, 591, 593; 219/414, 453, 464, 506; 116/202, 280, DIG. 1

[56] References Cited

U.S. PATENT DOCUMENTS

| | | | |
|---|---|---|---|
| 3,416,251 | 12/1968 | Bordner | 40/564 |
| 3,978,633 | 9/1976 | Scheidler et al. . | |
| 4,852,284 | 8/1989 | Faggiano | 40/594 X |
| 4,990,750 | 2/1991 | Martel et al. | 219/453 |

FOREIGN PATENT DOCUMENTS

| | | | |
|---|---|---|---|
| 3341210 | 5/1985 | Germany . | |
| 4007971 | 9/1991 | Germany . | |
| 9205907 | 8/1992 | Germany . | |
| 4064823 | 2/1992 | Japan | 219/453 |
| 5033947 | 2/1993 | Japan | 219/453 |
| 1346574 | 2/1974 | United Kingdom | 219/453 |

*Primary Examiner*—Brian K. Green
*Attorney, Agent, or Firm*—Walter Ottesen

[57] ABSTRACT

An arrangement displays information and operating states on an apparatus such as a cooking apparatus having a plate made of glass and/or glass ceramic and defining a lower surface and a transparent upper surface area where the information is viewed by an operator. The arrangement includes an attachment member; an adhesive for fixedly mounting the attachment member to the lower surface; a display device for generating a light display of the information and operating states below the plate to permit an operator to view the information and operating states through the plate by looking at the upper surface thereof; and, a connecting device for connecting the display device to the attachment member.

20 Claims, 4 Drawing Sheets

ARRANGEMENT FOR DISPLAYING INFORMATION AND OPERATING STATES ON A COOKING APPARATUS

FIELD OF THE INVENTION

The invention relates to an arrangement for displaying information including operating states on apparatus such as cooking apparatus. The cooking apparatus includes a plate made of transparent glass and/or glass ceramic which has a surface area which can be profiled. The display is provided through the plate. More specifically, the display is viewed through the plate via a viewing window which is formed by filling out the profile with a transparent mass until a smooth even surface is formed.

BACKGROUND OF THE INVENTION

So-called heat displays or residual-heat displays have been known for a long time for apparatus such as cooking apparatus. The cooking apparatus includes a glass and/or glass-ceramic plate defining a surface area. The displays signal to the user whether the cooking zone is hot or has already cooled off to the extent that the user can touch the cooking zone without receiving a burn injury.

German published utility model application 9,205,907.4 discloses an arrangement for displaying residual heat on electrical cook plates. These cook plates are covered with a glass-ceramic plate when the cooking apparatus is assembled. A display lamp is connected to a holder which has two mutually parallel attachment arms. The first attachment arm engages the base of a formed metal part in the region of a punched hole located near the first peripheral edge thereof. This first attachment arm attaches in the punched hole with a catch. The second attachment arm has latching means which engage the second peripheral edge of the formed-metal part.

German Patent 3,341,210 discloses a cooking assembly having a plate preferably made of glass or glass-ceramic material. Attachment members are fixedly attached to the lower side utilizing adhesive material. The attachment members can themselves be made of adhesive material. The invention disclosed in this patent has as its object to provide a cooking assembly having a configuration which is significantly simplified and requires fewer attachment parts especially for attaching the heater elements.

U.S. Pat. No. 3,978,633 discloses a plate made of glass ceramic or glass having a coefficient of thermal expansion of less than $50\times10^{-7}/°C$. The plate is connected to an attachment device for attaching to a base and/or to an edge protector to protect against mechanical damage. The connection between the plate and the attachment device or between the plate and the edge protector is provided by permanently-elastic connecting material made on the basis of silicone rubber.

German published patent application 4,007,971 discloses an arrangement for switching electronic devices especially for cooking areas or the like. A light transmitter and a light receiver are mounted below a glass-ceramic plate which is adequately transparent in the transmission wavelength range of the light transmitter. Luminous displays in combination with optical IR switching elements (namely a light transmitter and a light receiver) are suggested which are attached to the lower side of the glass-ceramic plate utilizing a transparent silicone layer.

SUMMARY OF THE INVENTION

It is an object of the invention to provide an arrangement for displaying information and especially operating states which are informative for the user and necessary for the user's safety. It is still another object of the invention to provide such an arrangement which can be mounted and attached simply and quickly, that is, without adjustments being necessary on the glass or glass-ceramic surface and which can be mounted in precise position to the decor.

The arrangement of the invention is for displaying information and operating states. The information and operating states are displayed on an apparatus such as a cooking apparatus having a plate made of glass and/or glass ceramic and defining a lower surface and a transparent upper surface area where the information is viewed by an operator. The arrangement includes: an attachment member; adhesive means for fixedly mounting the attachment member to the lower surface; a display device for generating a light display of the information and operating states below the plate to permit an operator to view the information and operating states through the plate by looking at the upper surface thereof; and, connecting means for connecting the display device to the attachment member.

Apparatus of the kind referred to above can be provided with a plate made of glass and/or glass ceramic wherein the plate has a transparent but profiled lower surface. For apparatus of this kind, another embodiment of the arrangement according to the invention includes: a transparent mass filling out at least a portion of the profiled lower surface to provide a smooth planar surface defining a viewing window; an attachment member fixedly adhering to the transparent mass; a display device for generating a light display of the information and operating states below the plate to permit an operator to view the information and operating states through the viewing window and the plate by looking at the upper surface thereof; and, connecting means for connecting the display device to the attachment member.

The attachment member is preferably made of plastic such as an injection molded plastic and defines a mask having cutouts for different legends and especially for passing the light of the illuminating elements. Attachment members made of punched sheet metal or slip cast ceramic can also be used.

In an advantageous embodiment of the invention, the attachment member includes a holding device into which the exchangeable, individually formed masks can be inserted by clipping or latching. The holding device can be in the form of guide rails for holding the individually formed masks. The masks contain the written legends and/or symbols.

In a preferred embodiment, the attachment member includes a self-adhering transparent adhesive layer so that this member can be glued to the profiled or smooth lower side of, for example, a panel. The attachment member can be mounted by itself or in combination with the lamp carrier or the display unit when assembling the cooking apparatus.

The transparent adhesive layer should have sufficient adhesive force which is effective at temperatures occurring in the cooking area during practical use. For this purpose, an acrylate adhesive is, for example, suitable. The display unit can be universally configured and the attachment adapter can have a specific configuration.

Plastic resins which cure are suitable as an adhesive and include, for example, epoxy resin, silicone resin, furan resin, polyester resin, acrylic resin or polyurethane resin. Thermoplastic resins which have good transparency are also suitable and include, for example, polyvinyl chloride, polystyrole polyester and especially acrylic resins, polycarbonate, polyvinylacetate and polyvinyl acetal.

In a preferred embodiment, the display unit can be connected so as to be separable from the attachment member which is glued tightly to the glass or glass-ceramic plate. The display unit is clipped or latched into cutouts of the attachment member or is accommodated in guide rails.

The display unit includes information elements such as clocks, timing clocks, corporate trademarks, instructions for use and/or warning notices and elements for displaying the states of the cooking apparatus and especially of the cooking plates. These elements can include displays indicating "hot" and/or "residual heat" and can be controlled from below by illuminating devices such as lamps, glow lamps, incandescent lamps or even cold light sources which are driven by glass and/or plastic fibers.

BRIEF DESCRIPTION OF THE DRAWINGS

The invention will now be described with reference to the drawings wherein.

DESCRIPTION OF THE PREFERRED EMBODIMENTS OF THE INVENTION

Figure 1:
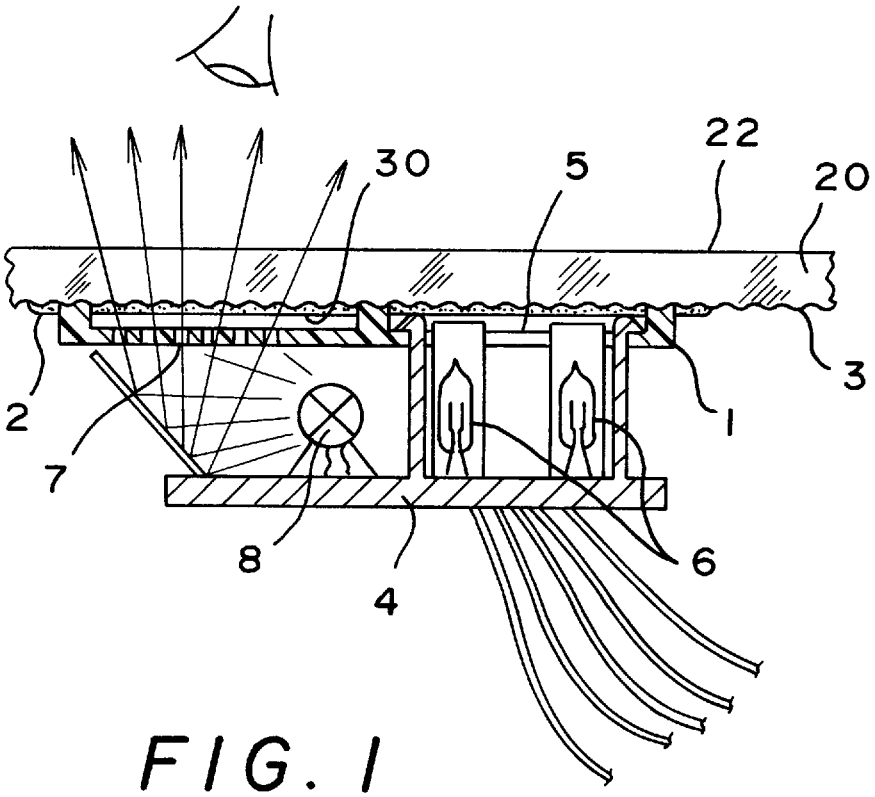
FIG. 1 is a side elevation view, in section, showing a first embodiment of an arrangement according to the invention for displaying information on the cooking surface of a cooking apparatus.

FIG. 1 shows a flat attachment member 1 made of a temperature-resistant plastic. A plate 20 made of glass ceramic has a lower side 3 which is burled to provide a profiled surface to which a mass 2 is applied. The mass 2 can be referred to as an immersion layer and the attachment member 1 is seated in this immersion layer 2 while it is still soft. The attachment member 1 can be back illuminated and directed toward the decor on the cooking surface of the glass-ceramic plate 20.

After the immersion layer has cured, the glass-ceramic plate together with the attachment member 1 can be packed and shipped. The significant advantage compared to present configurations is the simplified assembly afforded at the production facility of the range manufacturer. Likewise, a defined position of the display elements relative to the decor or pattern on the upper side 22 (cooking surface) of the glass-ceramic plate is provided because the range manufacturer only has to clip in the display unit 4 having lamps (6, 8) into the attachment member 1.

The attachment member 1 includes one or several cutouts 5 for the display lamps 6 (usually four are provided) for indicating the condition "hot" or "residual heat". In a special embodiment, and in addition to the one or several cutouts 5, the attachment member 1 also includes legends defined by masks 7 which indicate, for example, "hot surface", "warming zone", "hot" or appropriate symbol displays.

Corporate trademarks can also be included such as the trademark or logo of a particular range manufacturer whereby additional possibilities for configuration are given.

The display unit 4 is configured as a lamp carrier and can then, additionally, be equipped with one or several lamps (6, 8). The lamps 8 are usually glow lamps for illuminating the masks from behind.

The lamp carrier, that is, the display unit 4 can then be so configured that it is universally useable and only the attachment member 1 must be made specific for a particular customer with different legends and/or symbol representations.

Figure 2:
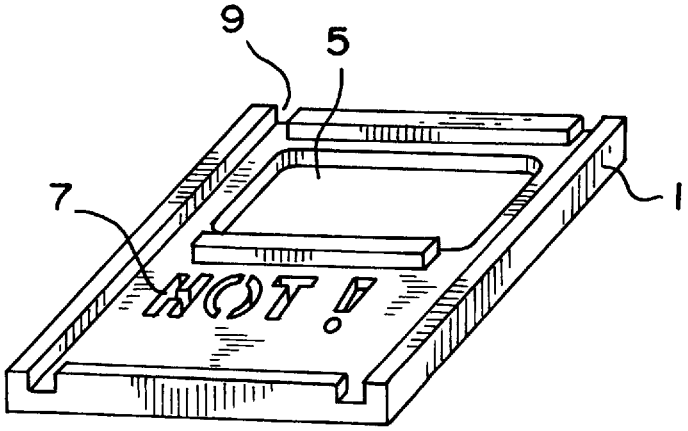
FIG. 2 is a perspective view of an embodiment of the attachment member of the arrangement shown in FIG. 1.

FIG. 2 shows the attachment member 1 which preferably has a flat configuration so that little space will be needed when packaging once the member 1 is attached to the glass-ceramic plate 20 defining the cooking surface 22. In addition, channel-like cutouts 9 are very advantageous because they facilitate the outflow of the displaced immersion material, that is, the material with which the profiled lower surface is provided for forming a viewing window. In the assembled state, and if constructively required, the lamps should be at a minimum spacing of 3 mm from the lower surface of the glass-ceramic plate 20 in order to prevent overheating because of heat emanating from the lower side of the plate.

The adhesive layer configured as an immersion layer simultaneously permits legends and/or symbol representations of the kind referred to above to be recognized very clearly and unmistakably from above without disturbance from the otherwise conventional burled structure on the lower side of the glass-ceramic plate 20. The mask with the legends 7 should not itself dip into the immersion layer 2 which usually has a thickness of 0.2 to 0.8 mm.

The back illumination of the legend displays and/or of the symbol displays is driven either separately and/or, for the legend "hot" or "hot surface", in such a manner that the legend glows as soon as at least one hot display is driven by a protective temperature limiter (STB) of the heater element.

Figure 3:
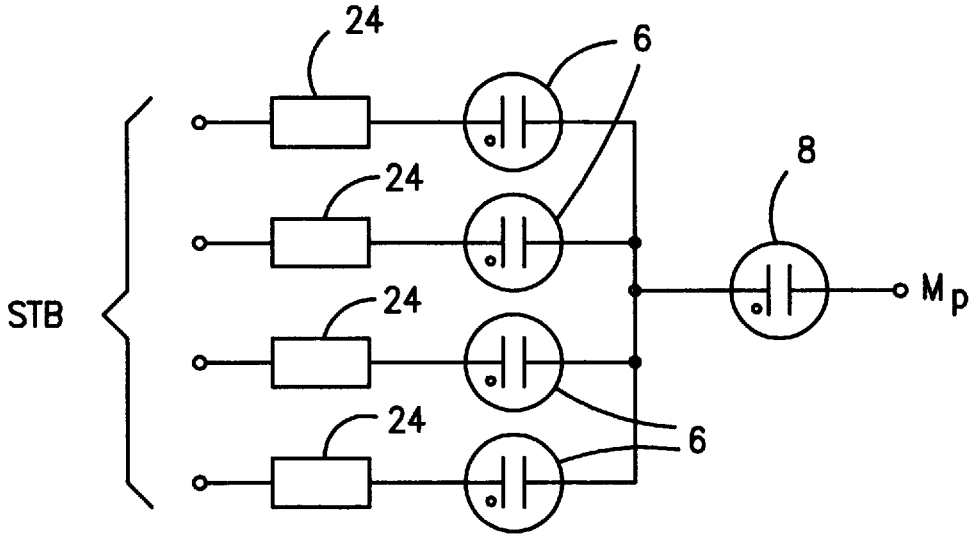
FIG. 3 is a schematic of a circuit of a plurality of parallelly-connected hot-display lamps connected in series with a back-illuminating lamp.

As shown in FIG. 3, this can be achieved in a simple manner with a series circuit of the lamp 8, which provides back illumination, connected to the set of lamps 6 which are connected in parallel with each other and provide the hot display. Each of the lamps 6 is connected in series with a resistor 24.

Figure 4:
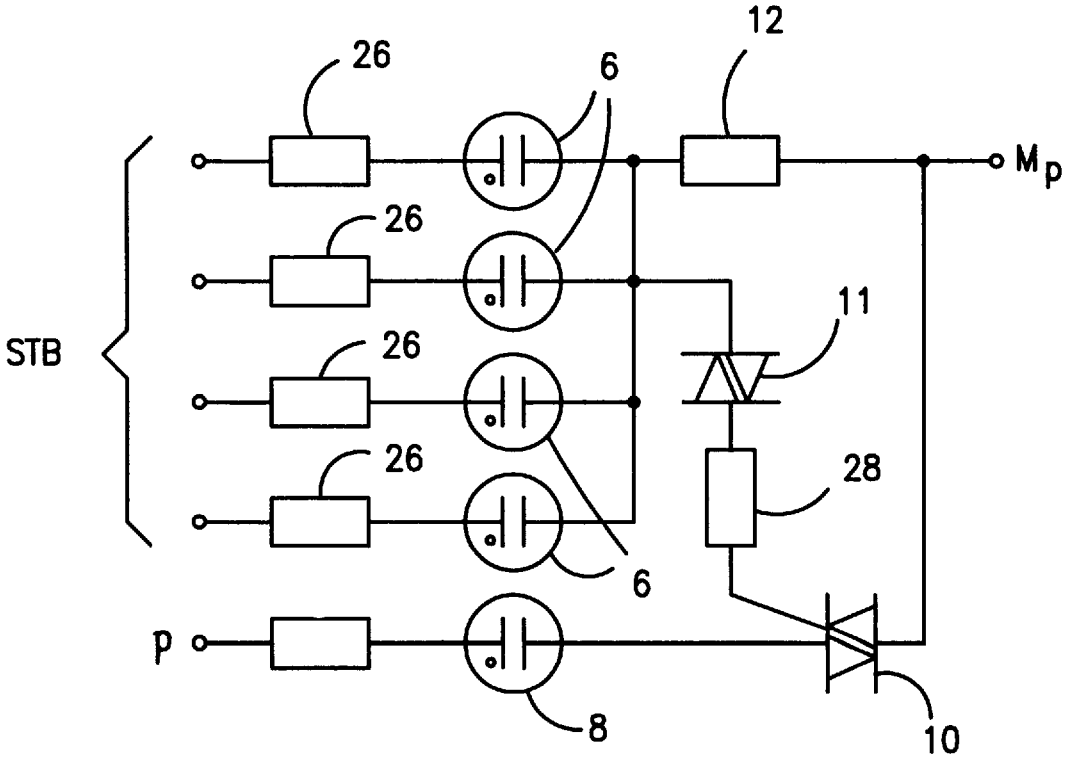
FIG. 4 shows how the back-illuminating lamp can be driven separately as soon as at least one hot-display lamp is switched on from the protective temperature limiter of a heater element.

FIG. 4 shows how lamp 8 (providing back illumination) is driven separately via a triac 10 as soon as at least one of the hot display lamps 6 is switched on by the protective temperature limiter (STB) of the heater element. If needed, a trigger diode 11 is connected into the control circuit of the triac 10 as shown. The protective temperature limiter operates to protect the cooking apparatus against extreme thermal loading by the heating elements. In this connection, reference can be made to the publication "Schott Information" Volume 1 (1980), pages 9 and 10.

The voltage drop across the resistor 12 ignites the triac 10. On the one hand, the series resistors 26 of the hot indicator lamps 6 and the resistor 12 must then be so dimensioned that an adequately high operating voltage appears across the hot indicator lamps 6 independently of the number of the hot indicator lamps which are driven. On the other hand, an adequately high ignition voltage must be made available for the gate of the triac 10 depending upon the particular type of triac. Usually, this gate voltage is approximately 30 Volts. The series resistor 28 operates to limit current.

The circuit can then be modified in such a manner that a simple thyristor is used in lieu of a triac. However, then only a half wave will be available for the back illumination lamp 8.

The circuit shown in FIG. 4 affords the advantage compared to the simple circuit of FIG. 3 that the back illumination lamp 8 glows with uniform brightness independently of the number of lamps 6 which are driven.

Figure 5:
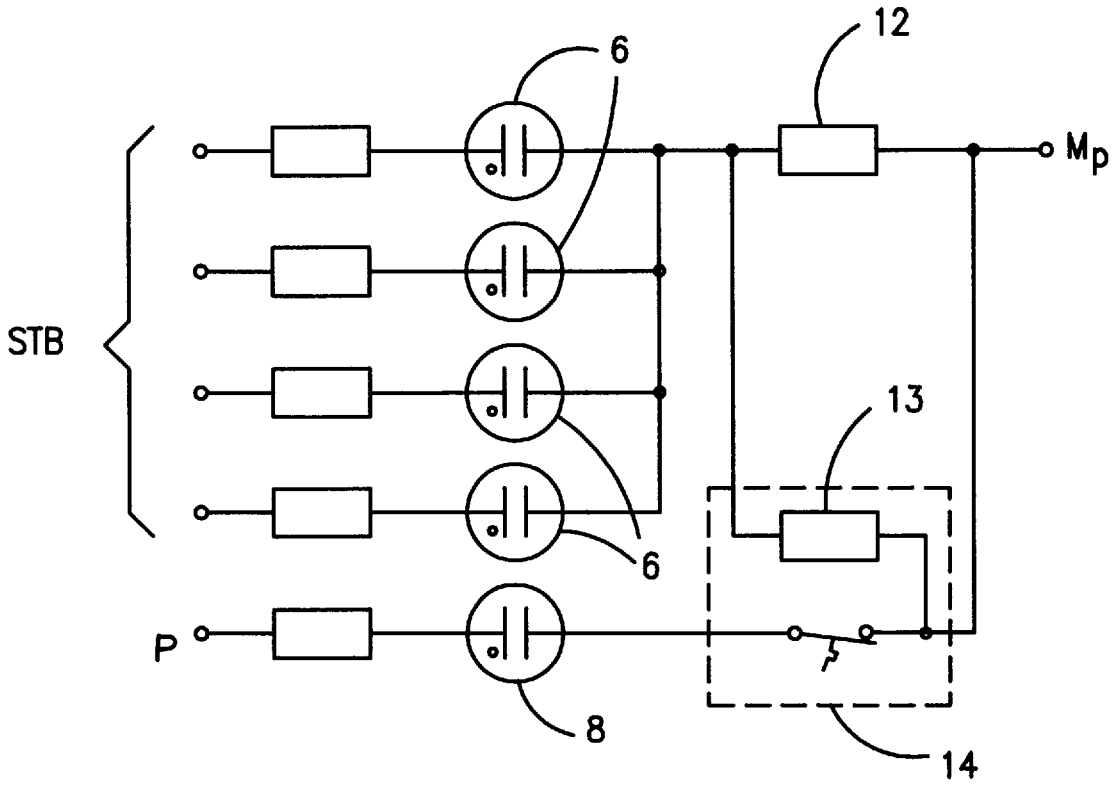
FIG. 5 is another embodiment of a circuit for driving the hot-display lamps and the back-illuminating lamp.

FIG. 5 shows a further embodiment for the drive circuitry. The voltage drop across the resistor 12 causes the thermistor 13 of a thermal relay 14 to heat and actuate the relay thereby driving the back illumination lamp 8.

Figure 6:
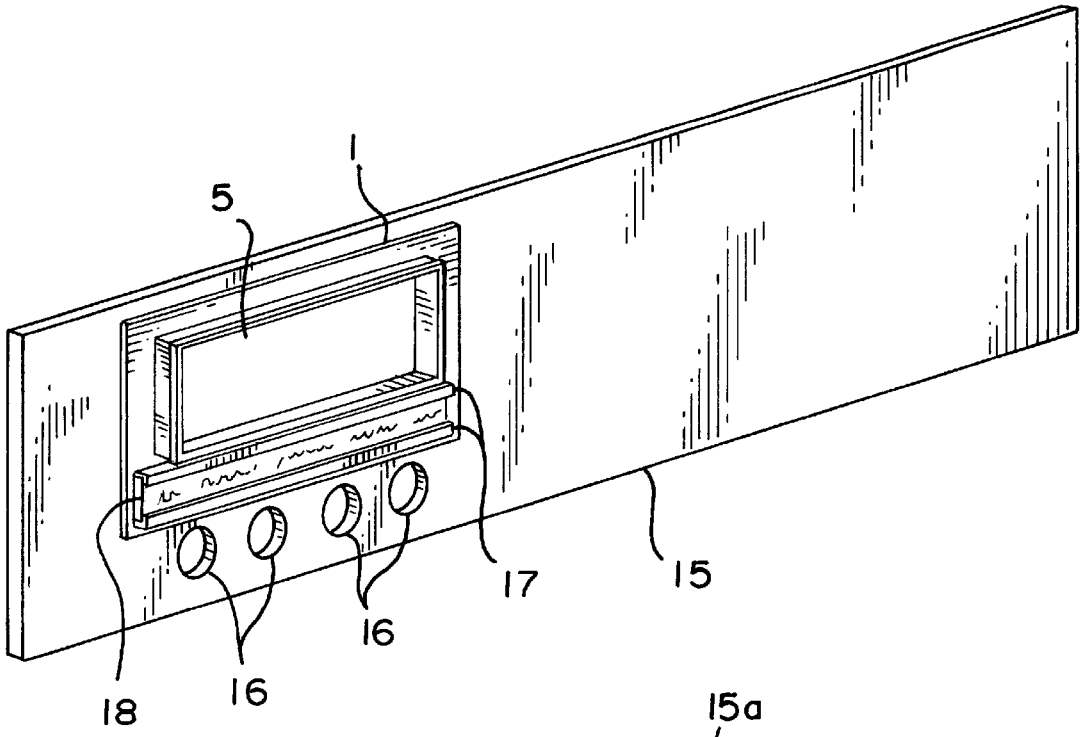
FIG. 6 is a perspective view of an embodiment of a user window made of pretensioned, printed soda-lime glass; and, FIG. 7 is a side elevation view, partially in section, of the user window shown in FIG. 6.
Figure 7:
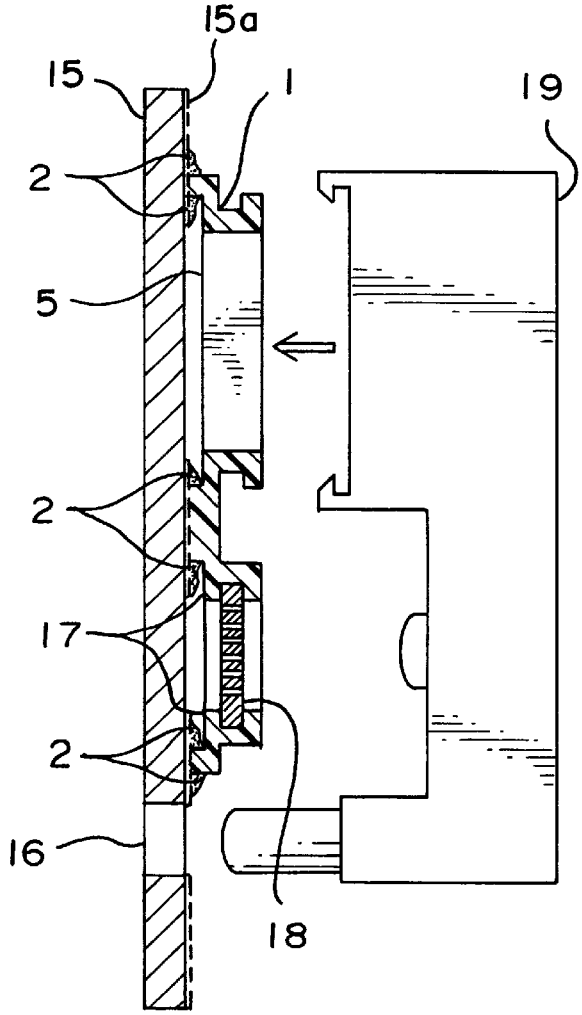

FIGS. 6 and 7 show a further embodiment incorporating a user window 15 made of pretensioned printed soda-lime glass. This pretensioned glass can, for example, be printed with the trademark DURAX®. This user window 15 is equipped with bores 16 for the switching elements of a timer 19. The attachment adapter 1 for the timer 19 is attached by means of a suitable adhesive such as silicone.

The cutout in the printing 15*a* is coextensive with the cutout 5 in the attachment adapter 1. The guide rails 17 accommodate legend and/or symbol masks 18 which explain the functions of the switching elements for the clock. The legend and/or symbol masks 18 are individually adaptable and, when required, can also be provided in the language of a particular country.

FIG. 7 shows the embodiment of FIG. 6 in section. In this embodiment, the adhesive 2 must not necessarily be transparent in the case, as shown here, where the adhesive is simply applied to peripheral regions of the attachment adapter 1.

It is understood that the foregoing description is that of the preferred embodiments of the invention and that various changes and modifications may be made thereto without departing from the spirit and scope of the invention as defined in the appended claims.

What is claimed is:

1. A cooking apparatus comprising:

a plate made of glass or glass ceramic;

said plate defining a lower surface and a transparent upper surface area where information and operating states of the cooking apparatus are viewed by an operator;

an attachment member;

adhesive means for fixedly mounting said attachment member directly to said lower surface;

a display device for generating a light display of said information and operating states below said plate to permit an operator to view said information and operating states through said plate by looking at said upper surface thereof;

connecting means for connecting said display device to said attachment member; and, said connecting means including means for releasably connecting said display device to said attachment member thereby facilitating a convenient connection of said display device to said attachment member and a convenient disconnection therefrom.

2. The cooking apparatus of claim 1, said attachment member being made of a material selected from the group consisting of plastic, metal and ceramic.

3. The cooking apparatus of claim 1, said attachment member having receptacle means formed thereon for mounting exchangeable, individually configured masks having legends and/or symbols formed therein; and, said display device including illuminating elements for back illuminating said legends and/or symbols.

4. The cooking apparatus of claim 3, said receptacle means including guide rails for receiving said masks therein.

5. The cooking apparatus of claim 1, said receptacle means being provided on said attachment member so as to make said attachment member self adhering to said lower surface of said plate.

6. The cooking apparatus of claim 1, said adhesive means being a curable synthetic resin selected from the group consisting of epoxy resin, silicone resin, furan resin, polyester resin, acrylic resin and polyurethane resin.

7. The cooking apparatus of claim 1, said connecting means including cutouts formed in said attachment member; and, engaging means on said display device for engaging said cutouts.

8. The cooking apparatus of claim 1, said connecting means including rails formed on said attachment member; and, engaging means on said display device for engaging said rails.

9. The cooking apparatus of claim 1, wherein said display device includes information units including clocks, timers, manufacturer's logo, operating instructions, warming notices, elements for displaying said operating states including "hot" and/or "residual heat"; and, lighting devices including lamps, glow lamps, incandescent lamps and luminous diodes which are supplied via glass and plastic fibers.

10. An arrangement for displaying information and operating states on an apparatus having a plate made of glass or glass ceramic and defining a lower surface and a transparent upper surface area where said information is viewed by an operator, the arrangement comprising:

an attachment member;

adhesive means for fixedly mounting said attachment member directly to said lower surface;

a display device for generating a light display of said information and operating states below said plate to permit an operator to view said information and operating states through said plate by looking at said upper surface thereof;

connecting means for connecting said display device to said attachment member;

said connecting means including means for releasably connecting said display device to said attachment member thereby facilitating a convenient connection of said display device to said attachment member and a convenient disconnection therefrom; and, said attachment member being configured to include a mask having cutouts formed therein to define a legend; and, said display device including an illuminating element for generating light to back illuminate said mask whereby said legend can be seen by the operator through said upper surface area.

11. A cooking apparatus comprising:

a plate made of glass or glass ceramic;

said plate defining a lower surface and a transparent upper surface area where information and operating states of the cooking apparatus are viewed by an operator;

said plate having a profiled lower surface;

a transparent adhesive mass applied to at least a portion of said profiled lower surface and filling out at least said portion of said profiled lower surface to provide a smooth planar surface defining a viewing window;

an attachment member fixedly adhering to said transparent adhesive mass so as to leave a portion of said viewing window exposed;

a display device for generating a light display of said information and operating states below said exposed portion of said viewing window and said plate to permit an operator to view said information and operating states through said exposed portion of said viewing window and said plate by looking at said upper surface thereof;

connecting means for connecting said display device to said attachment member; and, said connecting means including means for releasably connecting said display device to said attachment member thereby facilitating a convenient connection of said display device to said attachment member and a convenient disconnection therefrom.

12. The cooking apparatus of claim 11, said transparent adhesive mass being a curable substance; and, said attachment member having raised portions immersed in said transparent mass which tightly holds said attachment member after said substance has cured.

13. The cooking apparatus of claim 11, said attachment member being made of a material selected from the group consisting of plastic, metal and ceramic.

14. The cooking apparatus of claim 11, said attachment member having receptacle means formed thereon for mounting exchangeable, individually configured masks having legends and/or symbols formed therein; and, said display device including illuminating elements for back illuminating said legends and/or symbols.

15. The cooking apparatus of claim 14, said receptacle means including guide rails for receiving said masks therein.

16. The cooking apparatus of claim 11, said transparent adhesive mass being an adhesive layer of a curable synthetic resin selected from the group consisting of epoxy resin, silicone resin, furan resin, polyester resin, acrylic resin and polyurethane resin.

17. The cooking apparatus of claim 11, said connecting means including cutouts formed in said attachment member; and, engaging means on said display device for engaging said cutouts.

18. The cooking apparatus of claim 11, said connecting means including rails formed on said attachment member; and, engaging means on said display device for engaging said rails.

19. The cooking apparatus of claim 11, wherein said display device includes information units including clocks, timers, manufacturer's logo, operating instructions, warming notices, elements for displaying said operating states including "hot" and/or "residual heat"; and, lighting devices including lamps, glow lamps, incandescent lamps and luminous diodes which are supplied via glass and plastic fibers.

20. An arrangement for displaying information and operating states on an apparatus having a plate made of glass or glass ceramic and said plate defining a transparent upper surface area where said information is viewed by an operator, the arrangement comprising:

said plate having a profiled lower surface;

a transparent adhesive mass applied to at least a portion of said profiled lower surface and filling out at least said portion of said profiled lower surface to provide a smooth planar surface defining a viewing window;

an attachment member fixedly adhering to said transparent adhesive mass so as to leave a portion of said viewing window exposed;

a display device for generating a light display of said information and operating states below said exposed portion of said viewing window and said plate to permit an operator to view said information and operating states through said exposed portion of said viewing window and said plate by looking at said upper surface thereof;

connecting means for connecting said display device to said attachment member;

said connecting means including means for releasably connecting said display device to said attachment member thereby facilitating a convenient connection of said display device to said attachment member and a convenient disconnection therefrom;

said attachment member being configured to include a mask having cutouts formed therein to define a legend; and, said display device including an illuminating element for generating light to back illuminate said mask whereby said legend can be seen by the operator through said upper surface area.

* * * * *

UNITED STATES PATENT AND TRADEMARK OFFICE

CERTIFICATE OF CORRECTION

PATENT NO. : 5,809,680

DATED : September 22, 1998

INVENTOR(S) : Herwig Scheidler, Bernd Schultheis, Martin Taplan and Erich Schroeder It is certified that error appears in the above-indentified patent and that said Letters Patent is hereby corrected as shown below:

In column 4, line 30: between "20." and "The", insert the sentence -- The adhesive layer 2 provides a smooth planar surface defining a viewing window 30. --

In column 7, line 39: delete "warm-" and substitute -- warn- -- therefor.

Column 6, line 16, delete "warming" and substitute --warning--.

Signed and Sealed this

Twenty-eighth Day of September, 1999

*Attest:*

Q. TODD DICKINSON

*Attesting Officer*

*Acting Commissioner of Patents and Trademarks*